US005749628A

United States Patent [19]

Synder et al.

[11] Patent Number: 5,749,628

[45] Date of Patent: May 12, 1998

[54] VERTICALLY ADJUSTABLE CHAIR ARM WITH ROTATABLE ARMREST

[75] Inventors: Bobbie L. Synder, Kansas City; C. Thomas Bradley, Raytown, both of Mo.; Paul W. Horner, Overland Park, Kans.

[73] Assignee: Fixtures Manufacturing Corporation, Kansas City, Mo.

[21] Appl. No.: 661,369

[22] Filed: Jun. 11, 1996

[51] Int. Cl.[6] ..... A47C 7/54

[52] U.S. Cl. ..... 297/411.36; 297/411.31

[58] Field of Search ..... 297/411.31, 411.3, 297/411.35, 411.36, 353; 248/118.3, 407, 423; 403/93, 97

[56] References Cited

U.S. PATENT DOCUMENTS 4,961,610 10/1990 Reeder et al. .
5,143,422 9/1992 Althofer et al. ..... 297/411.36
5,169,210 12/1992 Fricano .
5,324,096 6/1994 Schultz ..... 297/353
5,368,365 11/1994 Feldberg .
5,382,079 1/1995 Wilson et al. .
5,393,124 2/1995 Neil ..... 297/411.36
5,407,249 4/1995 Bonutti ..... 297/411.36
5,439,267 8/1995 Peterson et al. .
5,484,187 1/1996 Doerner et al. ..... 297/411.36

*Primary Examiner*—Milton Nelson, Jr.
*Assistant Examiner*—Anthony D. Barfield
*Attorney, Agent, or Firm*—Litman, McMahon and Brown, L.L.C.

[57] ABSTRACT

A vertically adjustable chair arm with a rotatable armrest includes an armrest support member extending upwardly from a chair seat and an armrest housing telescoped onto the support member. An armrest pad member is pivotally connected to a top end of the housing. A manually operated ratchet mechanism is engaged between the housing and the support member to releasably retain the housing in a selected vertical position on the support member. A spring ball detent mechanism is engaged between the armrest pad member and the housing and releasably retains the pad member in a selected pivotal position relative to the housing.

16 Claims, 3 Drawing Sheets

VERTICALLY ADJUSTABLE CHAIR ARM WITH ROTATABLE ARMREST

BACKGROUND OF THE INVENTION

Chairs for office workers who spend considerable amounts of their working time seated are often made adjustable to accommodate the variations in sizes and proportions of the workers. The reason for this is principally to position the worker in a seated posture to most efficiently accomplish their tasks, such as reading, typing, handwriting, and the like. It has been found that such ergonomic seating minimizes fatigue and repetitive motion injuries, such as carpal tunnel syndrome, thereby increasing the productivity of the workers and decreasing lost time required to get up and stretch or walk around. Such ergonomic seating which can be adjusted to the needs of the individual worker tends to be more comfortable over both short and long periods of sitting.

The most common type of chair adjustment is to the height of the seat member above the floor which is typically made by adjusting the length of a telescoping pedestal connecting the seat member with a support platform equipped with rollers or casters. Other common types of chair adjustments include the tilt of the seat member relative to the floor and the tilt of the chair back. Proper adjustment of the seat height, seat tilt, and chair back tilt provide adequate support for the thighs and back while allowing the feet to reach the floor. In addition to support, proper adjustment of the chair members give a sense of stability and controllability to the chair which adds to the sense of comfort.

The adjustments described above are adequate for so-called secretarial chairs, which do not have armrests. Office type chairs with armrests are generally referred to as executive chairs. Another type of office chair with arms is referred to as task seating which is intended for typing and keyboard entry activities. In addition to seat and chair back adjustments, executive chairs and, particularly, task seating can benefit from adjustability of the armrests. There have been a number of mechanisms for adjusting the height of armrests of executive chairs. Additionally, adjustments for the lateral position of armrests and the pitch of armrests about horizontal axes are known.

SUMMARY OF THE INVENTION

The present invention provides an adjustable chair arm which combines the capability of adjusting the height of the armrest pad with adjustments in the orientation of the pad about an upright or vertical axis. An armrest support member extends upward from a chair seat member and has an armrest housing telescoped thereover. A ratchet and spring biased pawl are engaged between the support member and the armrest housing, and a release lever connected to the pawl enables the pawl to be released from the ratchet for selective positioning of the housing relative to the support member and then secured in the desired position. An armrest pad member is pivotally connected to the upper end of the housing, and a spring ball detent mechanism is engaged between the pad member and the housing and enables to pad to be pivoted to a desired position and releasably secured. The housing with pawl mechanism and pad form a movable chair arm subassembly, while the support member and ratchet member form a stationary chair arm subassembly of the adjustable chair arm assembly of the present invention.

The armrest support member is a flattened metal member including a lower, horizontal seat attachment leg which curves into an upper, upright armrest support leg. An upper segment of the upright leg has rectangular cutouts on the opposite side margins of the upright leg, each cutout forming an upper and a lower shoulder. The horizontal leg has bores therethrough to receive fasteners such as screws to attach the support member to a chair frame member on the lower side of the chair seat.

The armrest housing is of a molded plastic construction and has a support passage therethrough to receive the upright leg of the support member telescopically therethrough. Elongated vertical ribs space an outer peripheral wall of housing about the upright leg of the support member. A control lever slot formed along a front edge of the housing has a pawl control lever pivotally connected therein with a pawl spring engaged between an abutment wall of the slot and the control lever. A pawl member is pivotally connected to a lower end of the control lever and is resiliently urged inwardly by the pawl spring. A ratchet member is received in a forwardly directed cutout of the upright leg of the support member and has the pawl member engaged therewith. The ratchet and pawl members, along with cooperating components, form a slide retainer mechanism to releasably retain the housing in a selected vertical position relative to the support member.

In a preferred embodiment of the adjustable chair arm assembly of the present invention, the ratchet member is an externally threaded rod which has about the same diameter and length as the width and length of the cutouts of the upright leg of the support member. The pawl member has a concave cylindrical surface which is internally threaded at the same thread pitch as the threads of the ratchet member. By this means, the threads of the pawl mesh with the threads of the ratchet. On a rearward side of the housing, a pair of vertically spaced stop pins extend between the walls of the housing and through the opposite cutout from the ratchet member. An upper stop pin engages an upper shoulder of the cutout to limit upward movement of the housing relative to the upright leg of the support member, while a lower stop pin engages a lower shoulder to limit downward movement of the housing.

An upper end of the housing diverges to receive an armrest pad support platform. A pivot bolt extends upward from the pad support platform and fastens to an armrest pad mounting plate to enable pivoting of the mounting plate relative to the support platform. An armrest pad member is fastened to the mounting plate. A ring of circumferentially spaced and diametrically paired detent impressions are formed in the upper surface of the support platform about the pivot bolt. A pair of diametrically opposed detent bores are formed into the lower surface of the mounting plate across the pivot bolt and receive sets of a detent spring and a detent bearing or ball. The detent balls and impressions, along with cooperating components, form a pivot retainer mechanism to releasably retain the pad member in a selected pivotal position about a vertical axis relative to the housing.

The components of the adjustable chair arm of the present invention are configured for use on either the right side or the left side of the chair depending on the manner of assembly. The support members for the right and left side of the chair are identical, and the movable chair arm subassemblies are interchangeable from the right and left sides. The armrest pads can be rotated to any desired position.

OBJECTS AND ADVANTAGES OF THE INVENTION

The principal objects of the present invention are: to provide an improved adjustable chair arm assembly, particular for executive type office chairs; to provide such an assembly in which the height of an armrest pad of the assembly relative to the chair seat and the pivotal orientation of the armrest pad about a vertical axis are adjustable for the comfort and posture of the chair occupant; to provide such an assembly including an armrest housing which is telescopically received over an armrest support member extending upwardly from a chair seat member; to provide such an assembly in which the armrest pad is pivotally connected to the armrest housing; to provide such an assembly including a slide retainer mechanism engaged between the housing and support member to releasably retain the housing in a selected vertical position relative to the support member; to provide such an assembly in which the slide retainer mechanism includes a ratchet member mounted on the support member and a resiliently biased pawl member connected to a control lever mounted on the housing; to provide such an assembly in which the ratchet member is an externally threaded rod and the pawl member has cooperating internal threads formed thereon; to provide such an assembly including a pivot retainer mechanism engaged between the armrest pad and the housing to releasably retain the pad in a selected pivotal position relative to the housing; to provide such an assembly in which the pivot retainer mechanism includes a resiliently biased ball detent mechanism; to provide such an assembly which can be interchangeably assembled for use on the right side or the left side of a chair; and to provide such a vertically and pivotally adjustable chair arm assembly which is economical to manufacture, attractive in appearance, convenient in use, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
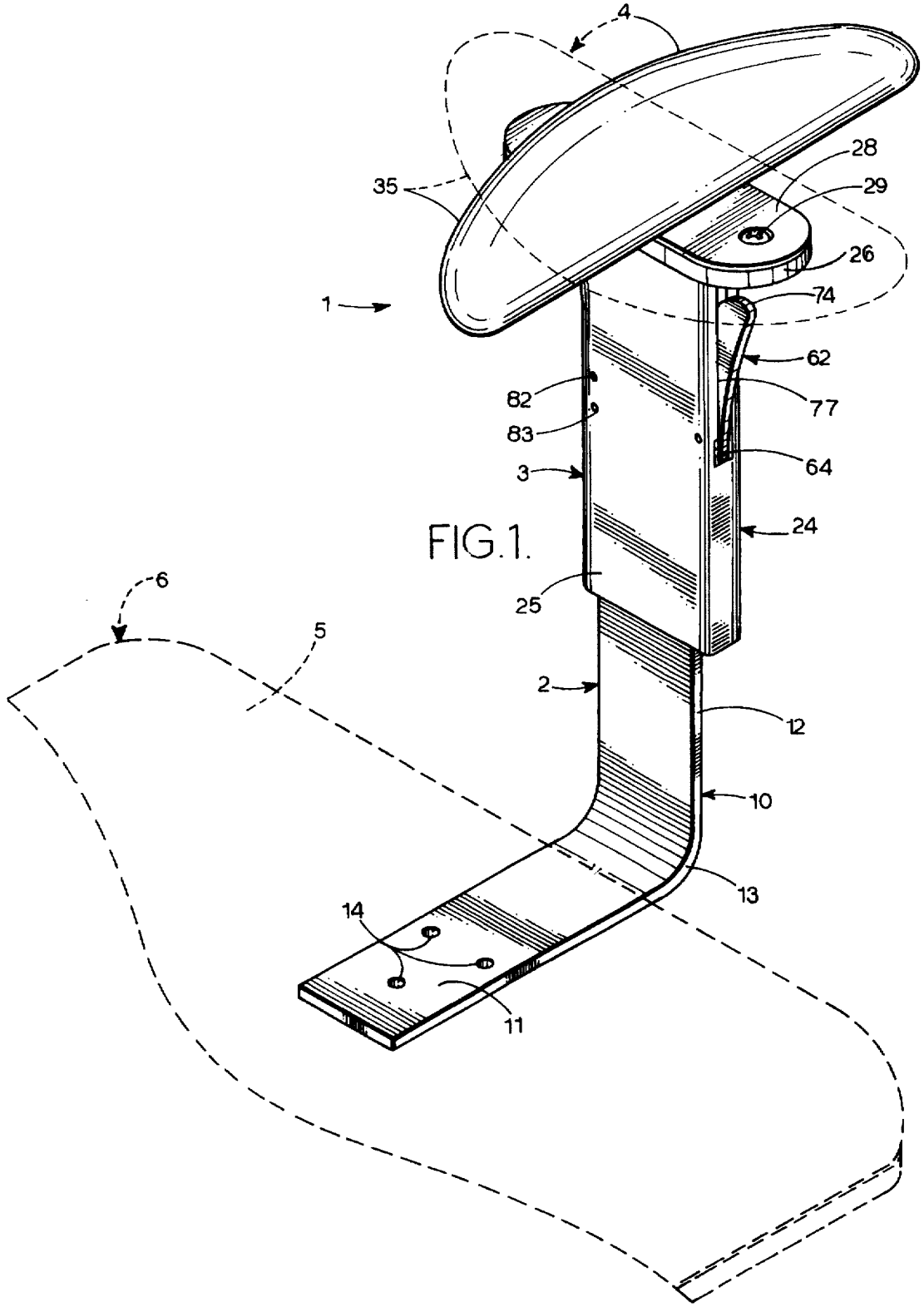
FIG. 1 is a perspective view of an adjustable chair arm assembly which embodies the present invention, with an alternate position of an armrest pad shown in phantom lines.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates an adjustable chair arm assembly which embodies the present invention. The assembly 1 generally includes a stationary chair arm subassembly or support unit 2 and a movable chair arm subassembly or armrest housing unit 3 having an armrest pad unit 4 pivotally connected thereto. The housing unit 3 is movable relative to the support unit 2 to enable vertical adjustment of the pad unit 4 relative to a chair seat member 5 of a chair 6, the pad unit 4 is pivotally adjustable about a substantially vertical pivot axis 7.

The chair 6 may be an executive type office chair or a chair of the type known as task seating, and the seat member 5 may be adjustable for height and tilt (not detailed). The support unit 2 includes a generally L-shaped support member 10 formed by a substantially horizontal leg 11 and an upright or vertical leg 12 extending upwardly from the horizontal leg 11. The angle between the horizontal and vertical legs 11 and 12 may be slightly obtuse to give the upright leg a somewhat diverging orientation relative to the seat member 5. On the illustrated support member 10, the horizontal and vertical legs 11 and 12 are connected by a curved bend 13. The support member 10 is a of a flattened shape and is preferably formed of a metal, such as steel or an aluminum alloy.

Figure 2:
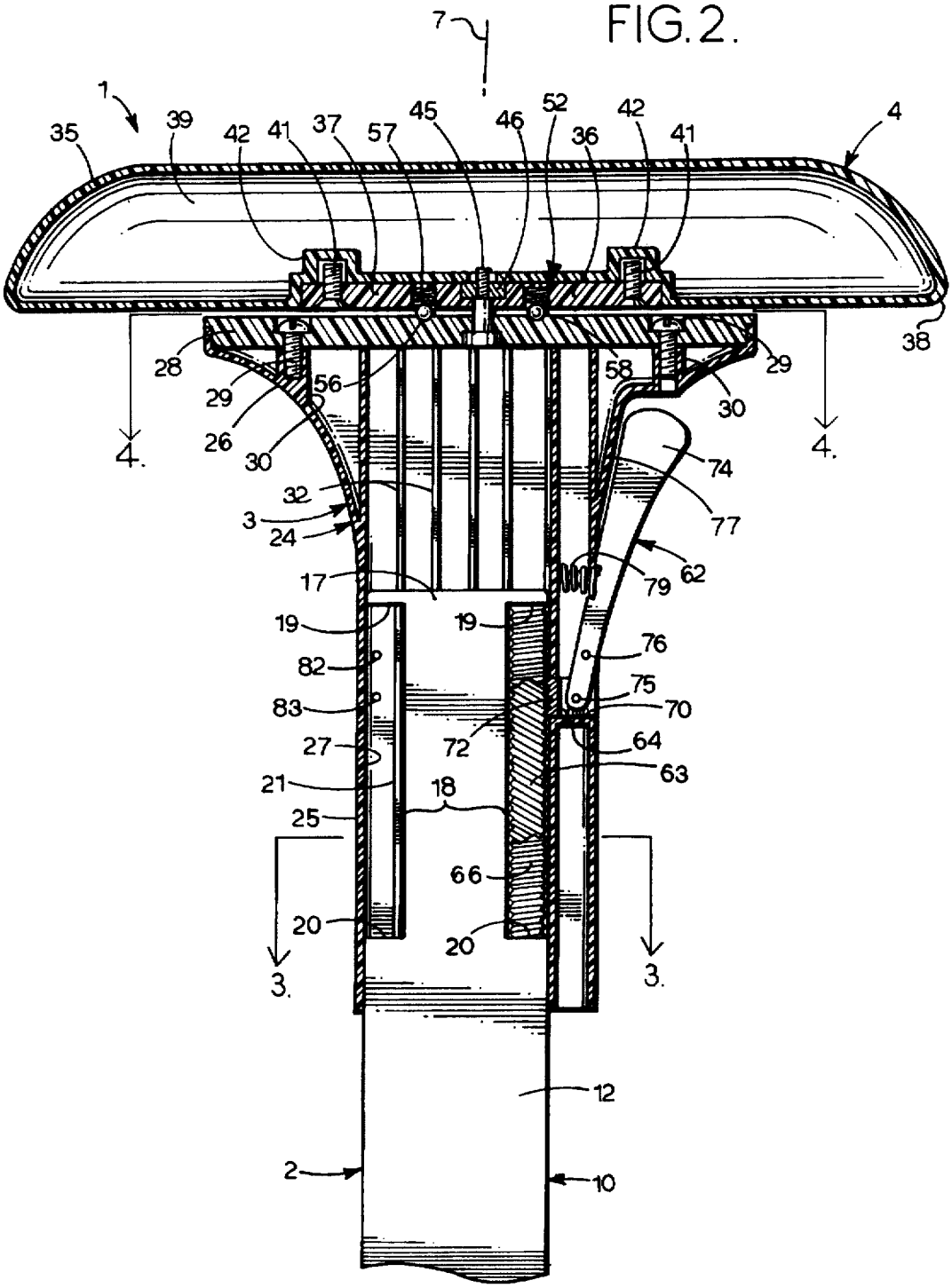
FIG. 2 is an enlarged fragmentary vertical sectional view of the adjustable chair arm assembly and illustrates details of a slide retainer mechanism and a pivot retainer mechanism of the assembly.
Figure 4:
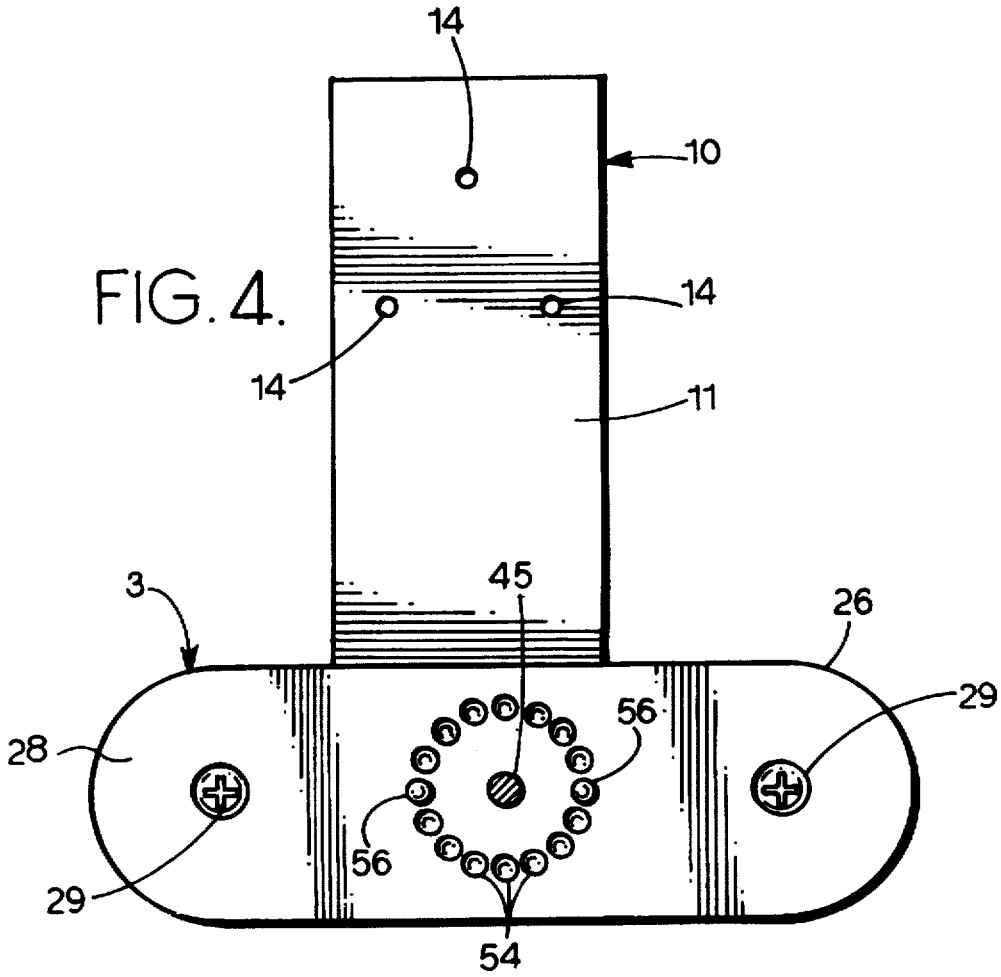
FIG. 4 is a top plan view at a reduced scale taken on line 4—4 of FIG. 2 and illustrates further details of the spring ball detent mechanism of the adjustable chair arm assembly.

The horizontal leg 11 of the support member 10 has bores 14 (FIGS. 1 and 4) to receive fasteners such as screws (not shown) to attach the support member 10 to the underside of a base member 15 of the chair seat member 5. An upper end 17 of the upright leg 12 has elongated, vertical rectangular cutouts 18 (FIG. 2) formed on opposite edges thereof. Each cutout 18 has an upper shoulder 19, a lower shoulder 20, and an inner edge 21. The cutouts 18 are preferably identical.

Figure 3:
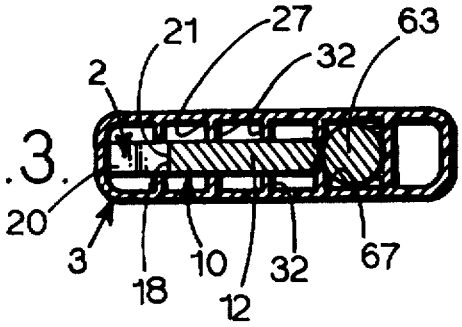
FIG. 3 is a further enlarged horizontal sectional view taken on line 3—3 of FIG. 2 and illustrates cooperation between a stem of an armrest housing and an armrest support member of the assembly.

The housing unit 3 includes an armrest housing 24 formed by a hollow, lower stem portion 25 which diverges into an upper platform portion 26. The stem portion 25 has a support member receiving passage 27 (FIGS. 2 and 3) formed therethrough, and the platform portion 26 is closed by a platform plate 28. The platform plate 28 is connected to the platform portion 26 by fasteners such as screws 29 which are received in screw bosses 30 within the platform portion 26 of the housing 24. The stem portion 25 has vertical ribs 32 (FIGS. 2 and 3) extending into the passage 27 which stiffen the wall of the stem portion 25 and form slide bearings for sliding engagement with the upright leg 12 of the support member 10. Additionally, the ribs 32 maintain the position of the upright leg 12 within the passage 27. The housing 24 is preferably formed of a durable molded plastic which may be colored to match or coordinate with upholstery (not shown) on the seat member 5 and other components of the chair 6.

The pad unit 4 includes an armrest pad member 35 having an armrest pad mounting plate 36 positioned within a lower recess 37 of the pad member 35. The illustrated pad member 35 is formed by a durable plastic outer layer or skin 38 having a padding material 39, such as a foam resin, positioned therein, as by injection in a liquid state. The mounting plate 36 is connected to the pad member 35 by fasteners such as screws 41 extending into screw bosses 42 formed by the skin 38 within the recess 37. The bosses 42 may include some kind of nut member (not shown) embedded therein to positively receive the screws 41. The pad member 35 is pivotally connected to the housing 24 by a pivot bolt 45 extending between the platform plate 28 and the mounting plate 36 and a nut 46. A head of the bolt 45 is positioned in a bolthead recess 47 formed in the underside of the platform plate 28, and the nut 46 is positioned in a nut recess 48 formed in the upper side of the mounting plate 36. The bolt 45 is located along and forms the vertical pivot axis 7.

The assembly 1 includes a pivot retainer mechanism 52 engaged between the pad unit 4 and the housing 24 to releasably retain the pad member 4 in the desired pivotal position relative to the housing 24. In the preferred embodiment of the present invention, the pivot retainer mechanism 52 is a spring ball detent mechanism including a plurality of detent impressions 54 (FIG. 4) formed in the upper surface of the platform plate 28 in circumferentially spaced relation about the pivot axis 7 and the bolt 45. The detent impressions 54 are formed in diametrically opposed pairs across the bolt 45. The detent mechanism 52 includes a pair of detent balls 56 which are resiliently urged by detent springs 57 (FIG. 2) toward the platform plate 28. The detent springs 57 are located in detent spring recesses 58 in the underside of the mounting plate 36. The detent mechanism 52 allows the armrest pad 35 to be snapped into a plurality of positions about the bolt 45 relative to the housing 24.

The assembly 1 includes a slide retainer mechanism 62 engaged between the housing 24 and the upright leg 12 of the support member 10 to releasably retain the housing unit 3 in a desired vertical position relative to the support member 10. In the preferred embodiment of the assembly 1, the slide retainer mechanism 62 includes a ratchet member 63 and a pawl member 64. The ratchet member 63 is positioned in one of the cutouts 18 formed in the upper end of the upright leg 12. The illustrated ratchet member 63 is an elongated rod having external helical threads 66 formed on an external surface thereof. The ratchet member 63 has a length which allows it to fit loosely between the upper and lower shoulders 19 and 20 of the cutout 18. The ratchet member 63 is retained within the cutout 18 by a ratchet channel 67 (FIG. 3) formed by a pair of the ribs 32 extending inwardly from the wall of the stem portion 25.

The pawl member 64 is positioned within a pawl recess 70 formed in the stem portion 25 of the housing 24. The illustrated pawl member 64 has internal threads 72 formed on an end surface thereof which cooperate with the external threads 66 of the ratchet member 63. The end surface of the pawl member 64 is preferably cylindrically concave to conform to the external contour of the ratchet member 63. The pawl member 64 is pivotally connected to the lower end of a pawl release lever or control lever 74 by a pawl pivot pin 75. The pawl control lever 74 is pivotally connected to the housing 24 by a lever pivot pin 76 within a lever slot 77 formed on one side of the housing 24. A pawl spring 79 is engaged between the housing 24 and the lever 74 and resiliently urges the upper end of the lever 74 outward which urges the lower end of the lever 74 and the pawl member 64 inward into engagement with the ratchet member 63. The pivot pins 75 and 76 may be rolled spring pins.

The assembly 1 includes an upper stop pin 82 and a lower stop pin 83 (FIG. 2) which limit upward and downward movement of the housing 24 relative to the support member 10. The stop pins 82 and 83 extend between the walls of the stem portion 25 of the housing 24 through the cutout 18 on the opposite side from the ratchet member 63. Engagement of the upper stop pin 82 with the upper shoulder 19 limits upward movement of the housing 24, while engagement of the lower stop pin 83 with the lower shoulder 20 limits downward movement of the housing 24 relative to the upper leg 12. The ratchet member 63 fits either of the cutouts 18 whereby the housing unit 3 can be interchangeably assembled on a support member 10 one either the right side or the left side of the seat member 5 of the chair 6.

The adjustable chair assembly 1 of the present invention provides a wide range of vertical and pivotal adjustment of the position of the armrest pad unit 4 to support the forearms of an occupant of the chair 6. The armrest pad units 4 can be adjusted in such a manner as to support the forearms of a typist seated in the chair 6 in relation to a typing keyboard (not shown) to prevent repetitive motion injuries, such as carpal tunnel syndrome. The assembly 1 can also be easily and conveniently adjusted to the comfort requirements of virtually any occupant of the chair 6.

It is to be understood that while certain forms of the present invention have been illustrated and described herein, it is not to be limited to the specific forms or arrangement of parts described and shown.

What is claimed and desired to be secured by Letters Patent is as follows:

1. An adjustable chair arm assembly for a chair having a seat member and comprising:

(a) an arm support member extending upwardly from a chair seat member, said arm support member having a planar cross section with opposite edges;

(b) an armrest housing mounted in slidable relation to said support member and enabling substantially vertical movement of said housing relative to said support member, said housing including a flattened hollow stem section with opposite edge regions, said stem section being received about said support member in sliding, telescoping relation;

(c) a slide retainer mechanism engaged between said housing and said support member and releasably retaining said housing in a selected vertical position relative to said support member, said slide retainer mechanism including:

(1) a ratchet surface extending substantially along an edge of said support member;

(2) a pawl lever pivotally mounted in said stem section at one of said edge regions thereof;

(3) said pawl lever including a bawl end positioned internally within said stem section and including a pawl surface, said pawl surface facing said ratchet surface;

(4) a pawl spring engaged between said stem section and said pawl lever and resiliently urging said pawl surface into engagement with said ratchet surface to releasably retain said housing in said selected vertical position relative to said support member; and (5) said pawl lever having a control end opposite said pawl end, said control end being positioned external to said stem section for enabling manual pivoting of said pawl lever by one hand upon gripping said stem section to thereby release said bawl surface from engagement with said ratchet surface and enabling said vertical movement of said housing relative to said support member;

(d) an armrest pad member pivotally connected to said housing and enabling pivotal movement of said pad member about a substantially vertical axis; and (e) a pivot retainer mechanism engaged between said housing and said pad member and releasably retaining said pad member in a selected pivotal position relative to said housing.

2. An adjustable chair arm assembly for a chair having a seat member and comprising:

(a) an arm support member extending upwardly from a chair seat member;

(b) an armrest housing mounted in slidable relation to said support member and enabling substantially vertical movement of said housing relative to said support member;

(c) a slide retainer mechanism engaged between said housing and said support member and releasably retaining said housing in a selected vertical position relative to said support member, said slide retainer mechanism including:

(1) a pawl member cooperating with a ratchet member;

(2) said ratchet member being a ratchet rod mounted on said support member and having external threads formed thereon; and (3) said pawl member having internal threads formed thereon which cooperate with said external threads of said ratchet rod;

(d) an armrest pad member pivotally connected to said housing and enabling pivotal movement of said pad member about a substantially vertical axis; and (e) a pivot retainer mechanism engaged between said housing and said pad member and releasably retaining said pad member in a selected pivotal position relative to said housing.

3. An assembly as set forth in claim 2 and including:

(a) a pawl lever pivotally connected to said housing and having said pawl member pivotally connected thereto; and (b) a pawl spring is engaged between said housing and said pawl lever and resiliently causes said pawl lever to urge said pawl into releasable engagement with said ratchet member.

4. An assembly as set forth in claim 2 wherein:

(a) said pivot retainer mechanism includes a ball detent mechanism.

5. An assembly as set forth in claim 4 wherein said ball detent mechanism includes:

(a) a plurality of detent impressions formed into one of said housing or said pad member in circumferentially spaced relation about said vertical axis; and (b) a detent ball mounted on the other of said pad member or said housing and resiliently urged toward engagement with one of said detent impressions.

6. An assembly as set forth in claim 2 and including:

(a) said housing having a support member receiving passage formed therethrough; and (b) said support member being telescopically received within said passage to enable said housing to be slidable relative thereto.

7. An assembly as set forth in claim 2 and including:

(a) an upper slide stop member engaged between said housing and said support member and limiting upward movement of said housing relative to said support member; and (b) a lower slide stop member engaged between said housing and said support member and limiting downward movement of said housing relative to said support member.

8. An assembly as set forth in claim 2 wherein:

(a) said housing and said support member being configured to enable interchangeable placement of said assembly on a right side or a left side of said chair seat member.

9. An adjustable chair arm assembly for a chair having a seat member and comprising:

(a) an arm support member extending upwardly from a chair seat member;

(b) an armrest housing mounted in slidable, telescoping relation to said support member and enabling substantially vertical movement of said housing relative to said support member, said armrest housing including an upper platform plate with an upwardly oriented platform surface;

(c) a ratchet member mounted on said support member;

(d) a pawl member mounted on said housing and cooperating with said ratchet member to releasably retain said housing in a selected vertical position relative to said support member;

(e) an armrest pad member pivotally connected to said housing and enabling pivotal movement of said pad member about a substantially vertical axis, said armrest pad member including a lower armrest pad mounting plate with a downwardly facing mounting plate surface, said mounting plate surface facing said platform surface; and (f) a ball detent mechanism engaged between said pad member and said housing and releasably retaining said pad member in a selected pivotal position relative to said housing, said ball detent mechanism including:

(1) a plurality of detent impressions formed in one of said platform plate or said mounting plate in the respective surface thereof, said detent impressions being circumferentially spaced about said vertical axis; and (2) a detent ball resiliently mounted on the other of said platform plate or said mounting plate and being resiliently urged toward the respective surface having said detent impressions therein, said detent ball being radially spaced from said vertical axis to enable said detent ball to engage a detent impression at said selected pivotal positions of said armrest pad member relative to said housing.

10. An adjustable chair arm assembly for a chair having a seat member and comprising:

(a) an arm support member extending upwardly from a chair seat member;

(b) an armrest housing mounted in slidable, telescoping relation to said support member and enabling substantially vertical movement of said housing relative to said support member;

(c) a ratchet member mounted on said support member, said ratchet member being a ratchet rod mounted on said support member and having external threads formed thereon;

(d) a pawl member mounted on said housing and cooperating with said ratchet member to releasably retain said housing in a selected vertical position relative to said support member, said pawl member having internal threads formed thereon which cooperate with said external threads of said ratchet rod;

(e) an armrest pad member pivotally connected to said housing and enabling pivotal movement of said pad member about a substantially vertical axis; and (f) a ball detent mechanism engaged between said pad member and said housing and releasably retaining said pad member in a selected pivotal position relative to said housing.

11. An assembly as set forth in claim 10 and including:

(a) a pawl lever pivotally connected to said housing and having said pawl member pivotally connected thereto; and (b) a pawl spring is engaged between said housing and said pawl lever and resiliently causes said pawl lever to urge said pawl into releasable engagement with said ratchet member.

12. An assembly as set forth in claim 10 wherein said ball detent mechanism includes:

(a) a plurality of detent impressions formed into one of said housing or said pad member in circumferentially spaced relation about said vertical axis; and (b) a detent ball mounted on the other of said pad member or said housing and resiliently urged toward engagement with one of said detent impressions.

13. An assembly as set forth in claim 10 and including:

(a) said housing having a support member receiving passage formed therethrough; and (b) said support member being telescopically received within said passage to enable said housing to be slidable relative thereto.

14. An assembly as set forth in claim 10 and including:

(a) an upper slide stop member engaged between said housing and said support member and limiting upward movement of said housing relative to said support member; and (b) a lower slide stop member engaged between said housing and said support member and limiting downward movement of said housing relative to said support member.

15. An assembly as set forth in claim 10 wherein:

(a) said housing and said support member being configured to enable interchangeable placement of said assembly on a right side or a left side of said chair seat member.

16. An adjustable chair arm assembly for a chair having a seat member and comprising:

(a) an arm support member having a lower horizontal leg connected to a chair seat member and an upper, substantially upright leg extending upwardly from said horizontal leg;

(b) an armrest housing mounted in slidable, telescoping relation to said upright leg and enabling substantially vertical movement of said housing relative to said support member;

(c) a ratchet member mounted on said upright leg, said ratchet member being formed by a rod having external threads thereon;

(d) a pawl lever pivotally connected to said housing;

(e) a pawl member pivotally connected to said pawl lever, said pawl member having internal threads formed thereon which cooperate with said external threads of said ratchet rod;

(f) a pawl spring engaged between said housing and said pawl lever and resiliently causing said pawl lever to urge said pawl into releasable engagement with said ratchet member;

(g) an upper slide stop member engaged between said housing and said upright leg and limiting upward movement of said housing relative to said upright leg;

(h) a lower slide stop member engaged between said housing and said upright leg and limiting downward movement of said housing relative to said upright leg;

(i) an armrest pad member pivotally connected to said housing and enabling pivotal movement of said pad member about a substantially vertical axis; and (j) a plurality of detent impressions formed into one of said housing or said pad member in circumferentially spaced relation about said vertical axis;

(k) a detent ball mounted on the other of said pad member or said housing and resiliently urged toward engagement with one of said detent impressions; and (l) said detent impressions and said detent ball cooperating to releasably retain said pad member in a selected pivotal position about said vertical axis relative to said housing.

* * * * *